US008944546B2

(12) United States Patent
Miyajima

(10) Patent No.: US 8,944,546 B2
(45) Date of Patent: Feb. 3, 2015

(54) LIQUID EJECTION APPARATUS AND METHOD OF CONTROLLING THE SAME

(71) Applicant: Brother Kogyo Kabushiki Kaisha, Nagoya-shi, Aichi-ken (JP)

(72) Inventor: Yusuke Miyajima, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 23 days.

(21) Appl. No.: 13/852,940

(22) Filed: Mar. 28, 2013

(65) Prior Publication Data

US 2013/0257932 A1 Oct. 3, 2013

(30) Foreign Application Priority Data

Mar. 30, 2012 (JP) ..... 2012-079740

(51) Int. Cl.
*B41J 29/38* (2006.01)
*B41J 2/165* (2006.01)

(52) U.S. Cl.
CPC ..... *B41J 2/16505* (2013.01); *B41J 2/16585* (2013.01)
USPC ..... 347/5; 347/29

(58) Field of Classification Search
None
See application file for complete search history.

(56) References Cited

U.S. PATENT DOCUMENTS 6,474,774 B1 11/2002 Okamoto
8,201,917 B2 * 6/2012 Ito ..... 347/32
2011/0069102 A1 3/2011 Horade et al.

FOREIGN PATENT DOCUMENTS

JP 2001-162816 A 6/2001
JP 2011-067983 A 4/2011

* cited by examiner

*Primary Examiner* — Lisa M Solomon
(74) *Attorney, Agent, or Firm* — Merchant & Gould PC

(57) ABSTRACT

A liquid ejection apparatus including: a head having an ejection face and configured to eject liquid toward a recording medium; a capping mechanism which switches the ejection space being opposite the ejection face between capped and uncapped states; a conveyor which conveys the recording medium along a conveyance path; a sensor which senses whether the recording medium is present at a sensing position located on an upstream portion of the conveyance path; and a controller configured to: control the capping mechanism and the conveyor; determine whether the conveyor is normal, based on driving of the conveyor for a first period from the start of the driving of the conveyor in the capped state; and when the recording medium is sensed by the sensor within the first period, stop the driving of the conveyor even before the first period passes from the start of the driving of the conveyor.

9 Claims, 10 Drawing Sheets

LIQUID EJECTION APPARATUS AND METHOD OF CONTROLLING THE SAME

CROSS REFERENCE TO RELATED APPLICATION

The present application claims priority from Japanese Patent Application No. 2012-079740, which was filed on Mar. 30, 2012, the disclosure of which is herein incorporated by reference in its entirety.

BACKGROUND OF THE INVENTION

1. Field of the Invention

The present invention relates to a liquid ejection apparatus configured to eject liquid onto a recording medium and a method of controlling the liquid ejection apparatus.

2. Description of the Related Art

There is conventionally known a liquid ejection apparatus capable of performing maintenance of a liquid ejection head designed to eject liquid onto a recording medium.

As the above-described liquid ejection apparatus, there is known, for example, an ink jet recording apparatus including an ink-jet recording head that has an ejection face having ejection openings formed therein through which the head ejects ink onto a recording medium. This ink-jet recording apparatus may include a cap capable of isolating the ejection openings of the ink-jet recording head from an outside. In maintenance of the ink-jet recording head, the cap is positioned at a close-contact position at which the cap is held in close contact with the ink-jet recording head to prevent drying of the ejection openings (noted that this operation is called capping). In image recording, on the other hand, the cap is positioned at a distant position at which the cap is located farther from the ink-jet recording head than the close-contact position to allow the recording medium to pass through a position opposed to the ink-jet recording head (noted that this operation is called uncapping). When the cap is located at the close-contact position, driving of a conveyor mechanism (having conveyor rollers) for conveying the recording medium is stopped to prevent the recording medium from colliding against the cap. When the cap is moved from the close-contact position to the distant position, the conveyor rollers are rotated in a direction that is reverse to that in the image recording.

SUMMARY OF THE INVENTION

Incidentally, there is known a technique of driving the conveyor mechanism continuously for a predetermined length of time to determine whether there is a malfunction in the conveyor mechanism or not. Here, if the presence or absence of the malfunction in the conveyor mechanism is determined after the start of the uncapping and before the start of the liquid ejection onto the recording medium, a length of time required until the start of the liquid ejection onto the recording medium is increased by a length of time required for the determination.

This invention has been developed to provide: a liquid ejection apparatus capable of performing capping for a liquid ejection head configured to eject liquid onto a recording medium, the apparatus being capable of determining whether there is a malfunction in a conveyor mechanism or not before the liquid ejection onto the recording medium and capable of reducing a length of time extending from a beginning of uncapping to a beginning of the liquid ejection onto the recording medium; and a method of controlling the liquid ejection apparatus.

The present invention provides a liquid ejection apparatus comprising: a liquid ejection head comprising an ejection face in which a plurality of ejection openings are formed, the liquid ejection head being configured to eject liquid toward a recording medium through the plurality of ejection openings, an ejection space being opposite the ejection face; a capping mechanism configured to switch a state of the ejection space between a capped state in which the ejection space is substantially isolated from an ambient space of the ejection space and an uncapped state in which the ejection space communicates with the ambient space of the ejection space; a conveyor mechanism configured to convey the recording medium along a conveyance path; a recording-medium sensing device configured to sense whether the recording medium is present at a sensing position located on an upstream portion of the conveyance path, the upstream portion being located upstream of the ejection space; and a controller configured to: control the capping mechanism and the conveyor mechanism; execute a first determination of whether the conveyor mechanism is normal, the first determination being based on driving of the conveyor mechanism for a first period extending from a timing when the driving of the conveyor mechanism is started with the ejection space being in the capped state; and when the recording medium is sensed by the recording-medium sensing device within the first period, stop the driving of the conveyor mechanism even before the first period passes from the timing when the driving of the conveyor mechanism is started.

The present invention also provides a liquid ejection apparatus comprising: a liquid ejection head comprising an ejection face in which a plurality of ejection openings are formed, the liquid ejection head being configured to eject liquid toward a recording medium through the plurality of ejection openings, an ejection space being opposite the ejection face; a capping mechanism configured to switch a state of the ejection space between a capped state in which the ejection space is substantially isolated from an ambient space of the ejection space and an uncapped state in which the ejection space communicates with the ambient space of the ejection space; a conveyor mechanism configured to convey the recording medium along a conveyance path; a recording-medium sensing device configured to sense whether the recording medium is present at a sensing position located on an upstream portion of the conveyance path, the upstream portion being located upstream of the ejection space; a determination unit configured to determine whether driving of the conveyor mechanism is normal; and a controller configured to control the capping mechanism and the conveyor mechanism, the controller being configured to drive the conveyor mechanism for a first period extending from a timing when the driving of the conveyor mechanism is started with the ejection space being in the capped state, the determination unit being configured to determine whether the conveyor mechanism is normal, based on the driving of the conveyor mechanism for the first period from the timing when the driving of the conveyor mechanism is started with the ejection space being in the capped state, the controller being configured, when the recording medium is sensed by the recording-medium sensing device within the first period, to stop the driving of the conveyor mechanism even before the first period passes from the timing when the driving of the conveyor mechanism is started.

The present invention also provides a method of controlling a liquid ejection apparatus comprising: a liquid ejection head comprising an ejection face in which a plurality of ejection openings are formed, the liquid ejection head being configured to eject liquid toward a recording medium through the plurality of ejection openings, an ejection space being opposite the ejection face; a capping mechanism configured to switch a state of the ejection space between a capped state in which the ejection space is substantially isolated from an ambient space of the ejection space and an uncapped state in which the ejection space communicates with the ambient space of the ejection space; a conveyor mechanism configured to convey the recording medium along a conveyance path; and a recording-medium sensing device configured to sense whether the recording medium is present at a sensing position located on an upstream portion of the conveyance path, the upstream portion being located upstream of the ejection space, the method comprising: executing a first determination of whether the conveyor mechanism is normal, based on driving of the conveyor mechanism for a first period extending from a timing when the driving of the conveyor mechanism is started with the ejection space being in the capped state; and when the recording medium is sensed by the recording-medium sensing device within the first period, stopping the driving of the conveyor mechanism even before the first period passes from the timing when the driving of the conveyor mechanism is started.

According to the above-described liquid ejection apparatus and the method of controlling the liquid ejection apparatus, the determination of whether there is a malfunction in the conveyor mechanism or not can be performed when the ejection space is in the capped state. This makes it possible to shorten a length of time from a beginning of uncapping to a beginning of the liquid ejection on the recording medium. Also, when the recording-medium sensing device senses the recording medium at the sensing position located on the upstream portion of the conveyance path, the driving of the conveyor mechanism is stopped, resulting in reduction in a possibility that the recording medium collides against the capping mechanism.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

Hereinafter, there will be described one embodiment of the present invention by reference to the drawings.

Figure 1:
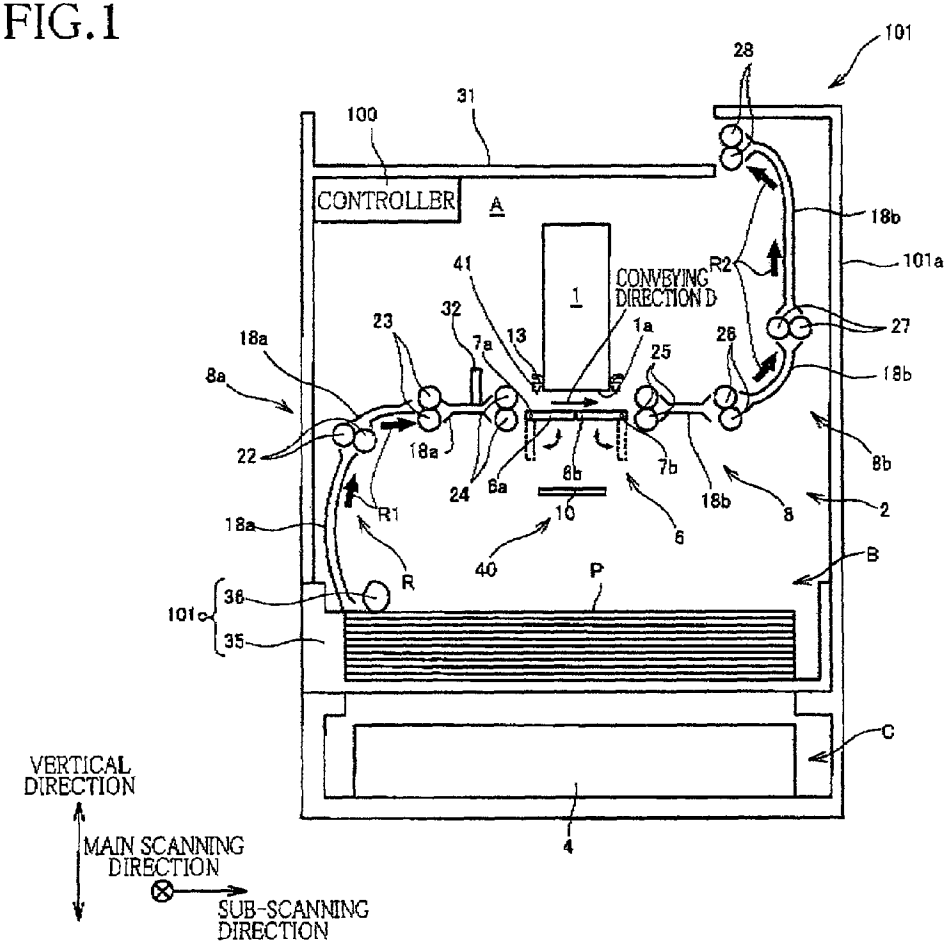
FIG. 1 is a side view generally illustrating an internal structure of an ink-jet printer as one example of a liquid ejection apparatus according to one embodiment of the present invention.

First, there will be explained, with reference to FIG. 1, an overall structure of an inkjet printer 101 as one example of a liquid ejection apparatus according to one embodiment of the present invention.

The printer 101 includes a housing 101*a* having a rectangular parallelepiped shape. A sheet-discharge portion 31 is provided on a top plate of the housing 101*a*. An inner space of the housing 101*a* can be divided into spaces A, B, C in order from an upper side thereof. In the spaces A, B is formed a conveyance path R that extends from a sheet-supply portion 101*c* to the sheet-discharge portion 31. A recording medium in the form of a sheet P is conveyed through this conveyance path R along bold arrows illustrated in FIG. 1. In the space A, image recording on the sheet P and the conveyance of the sheet P to the sheet-discharge portion 31 are performed. In the space B, the sheet P is supplied to an upstream conveyance path R1. In the space C is mounted a cartridge 4 from which ink is supplied toward an inkjet head 1, as one example of a liquid ejection head, provided in the space A.

In the space A are arranged various devices and components including: the ink-jet head 1 (hereinafter referred to as "head 1") for ejecting black ink; a supporting mechanism 6; a capping mechanism 40; a sheet sensor (as one example of a recording-medium sensing device) 32; a conveyor mechanism 2 including a guide mechanism 8; a display 120 (see FIG. 7); and a controller 100.

The head 1 is a line head having a generally rectangular parallelepiped shape elongated in a main scanning direction. A lower face of the head 1 is an ejection face 1*a* having a multiplicity of ejection openings 108 (see FIGS. 3A and 3B). During image recording, the black ink is ejected from the ejection openings 108. The head 1 is supported by the housing 101*a* via a head holder 13 and opposed to platens 6*a*, 6*b* which will be described below, with a predetermined space therebetween.

The head 1 is a stacked body including a head main body 3 (see FIG. 2), a reservoir unit 12 (see FIG. 5), a flexible printed circuit (FPC), and a circuit board. In the reservoir unit 12 as an upstream channel member is formed an upstream ink channel, not shown, having a reservoir, not shown. The ink is supplied from the cartridge 4 to this upstream ink channel.

The head main body 3 includes actuator units 21 and a channel unit 9 as a downstream channel member, and the ink in the reservoir unit 12 is supplied to this channel unit 9. A lower face of the channel unit 9 is the ejection face 1*a* from which the supplied ink is ejected through the ejection openings 108.

The circuit board adjusts and outputs signals received from the controller 100. The output signal is converted by a driver IC provided on the FPC, to a drive signal that is supplied to the actuator unit 21 of the head main body 3. When the actuator unit 21 is driven, the ink is ejected from the ejection openings 108.

In addition to the head 1, a cap member 41 of the capping mechanism 40 is mounted on the head holder 13. The cap member 41 is provided on the head 1 so as to enclose the head 1 in plan view. Like the head 1, the cap member 41 has a generally rectangular parallelepiped shape elongated in the main scanning direction as its longitudinal direction. The head 1 and the capping mechanism 40 will be explained later in detail.

The supporting mechanism 6 supports the conveyed sheet P from its lower side during the image recording. The supporting mechanism 6 includes the two platens 6*a*, 6*b* and a drive motor, not shown, for pivoting these platens 6*a*, 6*b*. The two platens 6*a*, 6*b* respectively have pivot shafts 7*a*, 7*b* each extending in the main scanning direction. Under the controller 100, the two platens 6*a*, 6*b* are pivoted by the drive motor between a support-face forming position and an open position. At the support-face forming position indicated by solid lines in FIGS. 1 and 4A, the two platens 6*a*, 6*b* extend horizontally, with their distal ends facing each other. At the open position illustrated in FIG. 4B, the two platens 6*a*, 6*b* extend downward such that their upper faces are parallel to each other. It is noted that the two platens 6*a*, 6*b* are normally located at the support-face forming position and located at the open position in a maintenance operation.

The guide mechanism 8 includes an upstream-side guide portion 8*a* and a downstream-side guide portion 8*b* for conveying the sheet P. The upstream-side guide portion 8*a* includes three guides 18*a*, three conveyor roller pairs 22-24, and three upstream motors 81-83 (see FIG. 7) for rotating these conveyor roller pairs 22-24, respectively. Together with a sheet-supply mechanism 36 which will be described below, the upstream-side guide portion 8*a* defines the upstream conveyance path R1 connecting between the sheet-supply portion 101*c* and the platens 6*a*, 6*b*.

The downstream-side guide portion 8*b* includes three guides 18*b*, four conveyor roller pairs 25-28, and four downstream motors 84-87 (see FIG. 7) for rotating these conveyor roller pairs 25-28, respectively. The downstream-side guide portion 8*b* defines a downstream conveyance path R2 connecting between the platens 6*a*, 6*b* and the sheet-discharge portion 31. Here, a sub-scanning direction is a direction which is parallel to a conveying direction D, indicated by arrow D in FIG. 1, in which the sheet P is conveyed by the conveyor roller pairs 24, 25, and the main scanning direction is a direction which is parallel to a horizontal plane and perpendicular to the sub-scanning direction. Also the upstream conveyance path R1 is a part of the conveyance path R which is located upstream of an ejection space S1, which will be described below, in the conveying direction D, and the downstream conveyance path R2 is a part of the conveyance path R which is located downstream of the ejection space S1 in the conveying direction D. Also, rotation-speed detection devices 91-97 (see FIG. 7) are provided respectively for rotation shafts of the upstream motors 81-83 and the downstream motors 84-87 to detect rotation speeds (or the numbers of rotation) of the respective motors 81-87. The rotation-speed detection devices 91-97 output the detected rotation speeds of the respective motors 81-87 to the controller 100.

The sheet sensor 32 determines the presence or absence of the sheet P at a sensing position that is located on a downstream end portion of the upstream conveyance path R1 in the conveying direction D. Upon this determination, the sheet sensor 32 outputs a sense signal that is used for the controller 100 to control operations of the head 1 and the conveyor mechanism 2.

Returning to FIG. 1, the sheet-supply portion 101*c* is disposed in the space B. The sheet-supply portion 101*c* includes: a sheet-supply tray 35 and the sheet-supply mechanism 36 partly constituting the conveyor mechanism 2. The sheet-supply tray 35 is removably mounted on the housing 101*a*. The sheet-supply tray 35 has a box shape opening upward and can accommodate a plurality of the sheets P. Also, the sheet-supply tray 35 is provided with a slidable sheet limiting mechanism, not shown, to accommodate sheets P of a plurality of sizes. The sheet-supply mechanism 36 is controlled by the controller 100 to supply an uppermost one of the sheets P accommodated in the sheet-supply tray 35. In the present embodiment, the conveyor mechanism 2 is constituted by the guide mechanism 8 and the sheet-supply mechanism 36. The sheet-supply mechanism 36 will be explained later in detail.

In the space C, the cartridge 4 storing the black ink is removably mounted on the housing 101*a*. The cartridge 4 is coupled to the head 1 by a tube, not shown, and a pump 38 (see FIG. 7). It is noted that the pump 38 is driven in forcible delivery of the ink to the head 1 (e.g., in a purging operation and initial supply of the liquid) and stopped in the other situations so as not to inhibit the ink supply to the head 1.

There will be next explained the controller 100. The controller 100 controls operations of the devices and components of the printer 101 to control operations of the printer 101. The controller 100 controls the image recording on the basis of a recording command, e.g., image data supplied from an external device such as a PC coupled to the printer 101. Upon receiving the recording command, the controller 100 drives the conveyor mechanism 2, i.e., the sheet-supply mechanism 36 and the guide mechanism 8. The sheet P supplied from the sheet-supply tray 35 is conveyed by the upstream-side guide portion 8*a* through the upstream conveyance path R1 onto a support face constituted by the platens 6*a*, 6*b*. When the sheet P is conveyed in the sub-scanning direction, i.e., in the conveying direction D, through a position just under the head 1, the controller 100 controls the head 1 to eject the ink from the ejection face 1*a* to record a desired image. It is noted that ink ejection timings are determined by the sense signals supplied from the sheet sensor 32. The sheet P with the image recorded thereon is conveyed by the downstream-side guide portion 8*b* through the downstream conveyance path R2 and discharged onto the sheet-discharge portion 31 from an upper portion of the housing 101*a*.

The controller 100 also controls a malfunction-existence determining operation as one example of a first determination and the maintenance operation for recovery and maintenance of liquid ejection characteristics of the head 1. The maintenance operation includes the purging operation, a flushing operation, and a capping operation.

In the purging operation, the controller 100 drives the pump 38 to forcibly discharge the ink from all the ejection openings 108. In this operation, actuators are not driven. In the flushing operation, the actuators are driven to eject the ink from the ejection openings 108. The flushing operation is performed on the basis of flushing data that differs from the image data.

Figure 4A:
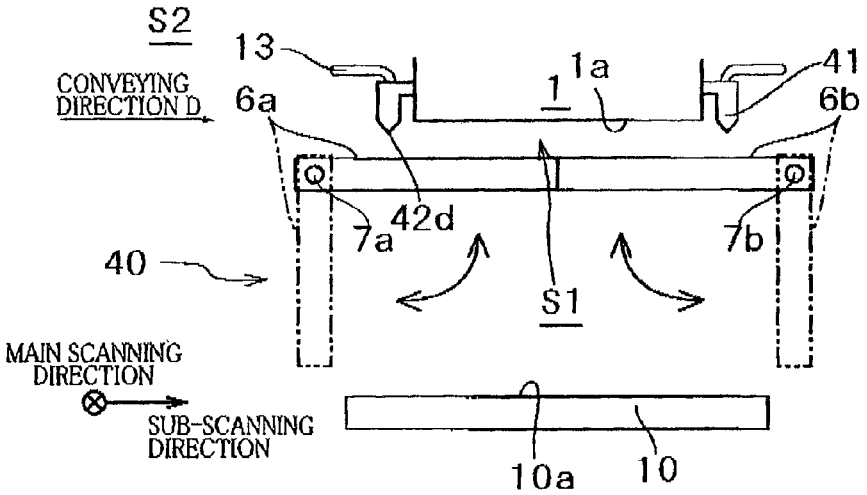
FIGS. 4A and 4B are views each illustrating a situation for explaining operations of a capping mechanism, a supporting mechanism, and a facing member.
Figure 4B:
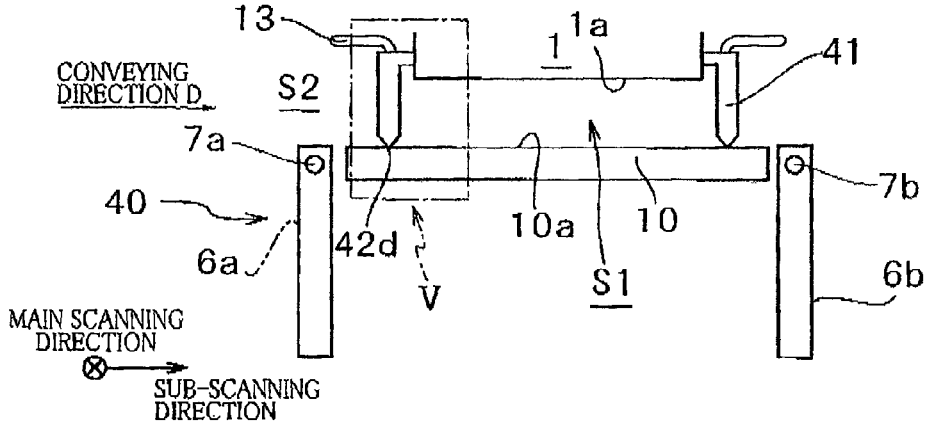

The capping operation is performed when the head 1 is at rest or not used. In the capping operation, as illustrated in FIG. 4B, the capping mechanism 40 encloses the ejection openings 108 together with the ejection face 1*a*. In this situation, the ejection space S1 opposite the ejection face 1*a* becomes a capped state in which the ejection space S1 is substantially isolated from an outside space S2 that is located outside the ejection space S1. As a result, a passage for releasing water of the ink in each ejection opening 108 is closed, which suppresses the increase in viscosity and drying of the ink.

The malfunction-existence determining operation is usually performed when the ejection space S1 is in an uncapped state in which the ejection space S1 is not substantially isolated from the outside space S2, that is, the ejection space S1 communicates with the outside space S2. The malfunction-existence determining operation includes: determination of whether or not there is a malfunction in the conveyor mechanism 2, i.e., the sheet-supply mechanism 36 and the guide mechanism 8; and determination of whether or not there is a sheet P remaining in the upstream conveyance path R1. The malfunction-existence determining operation will be explained later in detail.

Figure 2:
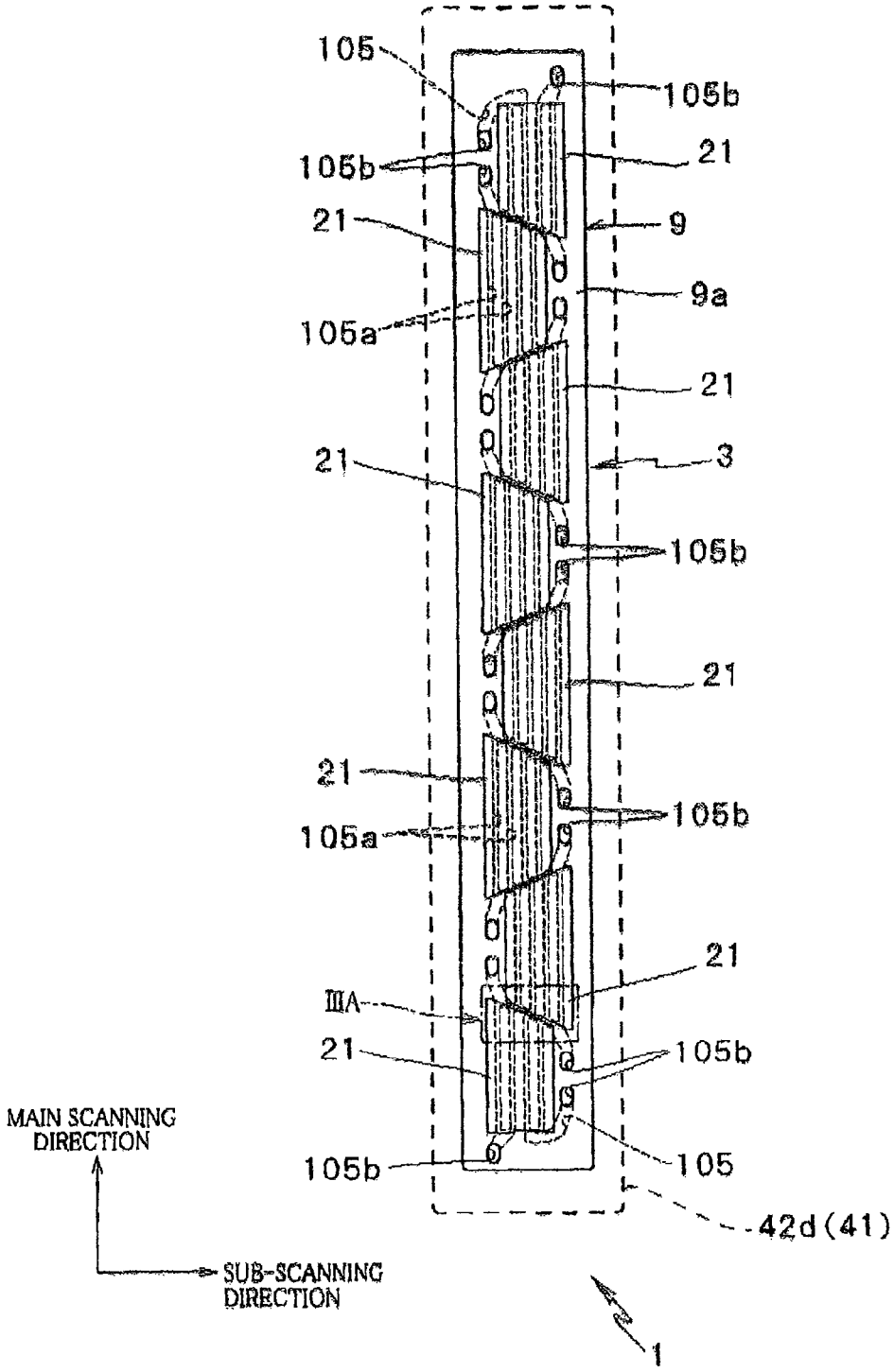
FIG. 2 is a plan view illustrating a head of the printer in FIG. 1.
Figure 3A:
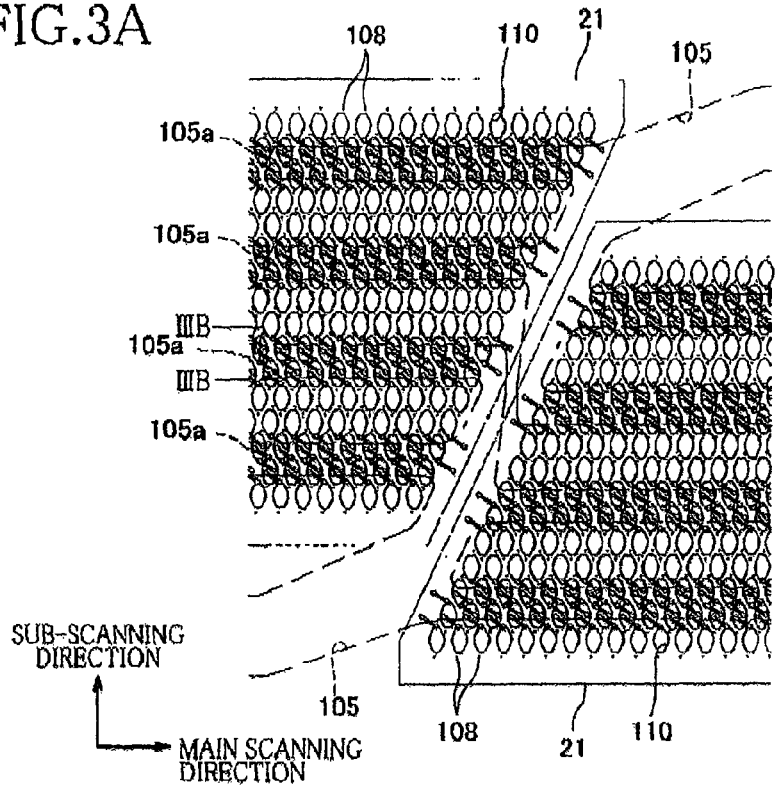
FIG. 3A is an enlarged view illustrating an area IIIA enclosed by one-dot chain line in FIG. 2.

There will be next explained the head 1 with reference to FIGS. 2 and 3. In FIG. 3A, pressure chambers 110 and the ejection openings 108 are illustrated by solid lines for easier understanding purposes though these elements are located under the actuator units 21 and thus should be illustrated by broken lines.

As illustrated in FIG. 2, the head main body 3 is a stacked body including the channel unit 9 and the eight actuator units 21 fixed to an upper face 9*a* of the channel unit 9. The pressure chambers 110 are open in the upper face 9*a*. As illustrated in FIG. 3C, the actuator units 21 seal these openings so as to act as side walls of the respective pressure chambers 110.

Figure 3B:
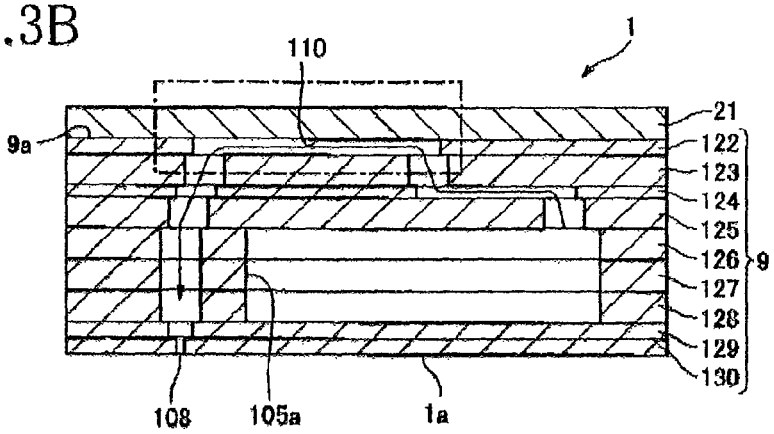
FIG. 3B is a partial cross-sectional view taken along line IIIB-IIIB in FIG. 3A.
Figure 3C:
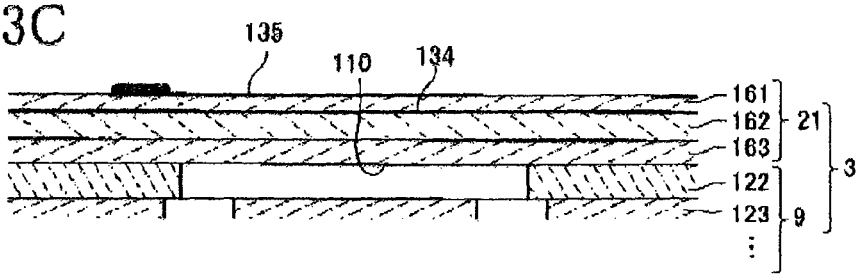
FIG. 3C is an enlarged view illustrating an area enclosed by one-dot chain line in FIG. 3B.

As illustrated in FIG. 3B, the channel unit 9 is a stacked body constituted by nine stainless plates 122-130 stacked on one another. Ink channels are formed in the channel unit 9. These ink channels include: manifold channels 105 each having, at its one end, a corresponding one of ink supply openings 105*b* formed in the upper face 9*a*; sub-manifold channels 105*a* each branched from a corresponding one of the manifold channels 105; and individual ink channels each extending from an outlet of a corresponding one of the sub-manifold channels 105*a* to a corresponding one of the ejection openings 108 formed in a lower face of the channel unit 9 via a corresponding one of the pressure chambers 110.

There will be next explained the actuator units 21. As illustrated in FIG. 2, each of the eight actuator units 21 has a trapezoid shape in plan view, and these actuator units 21 are arranged along the main scanning direction so as not to overlap the ink supply openings 105*b*.

As illustrated in FIG. 3C, each of the actuator units 21 is constituted by three piezoelectric layers 161-163 each formed of a ceramic material of lead zirconate titanate (PZT) having ferroelectricity. A multiplicity of individual electrodes 135 are disposed on an upper face of the uppermost piezoelectric layer 161 that is polarized in its thickness direction. Portions of the piezoelectric layer 161 sandwiched between the individual electrodes 135 and the pressure chambers 110 act as individual unimorph actuators. When an electric field is applied between one of the individual electrodes 135 and a common electrode 134 in the polarization direction, the corresponding actuator portion of the piezoelectric layer 161 is deformed so as to project toward the corresponding pressure chamber 110 (noted that this deformation is called a unimorph deformation). This deformation pressurizes the ink in the pressure chamber 110, causing an ink droplet to be ejected from the corresponding ejection, opening 108. Here, the common electrode 134 is always at ground potential. Also, drive signals are selectively supplied to the individual electrodes 135.

The present embodiment adopts what is called a fill-before-fire method for the ink ejection. Each individual electrode 135 is set at a predetermined electric potential in advance, keeping the unimorph deformation of the actuator. When the drive signal is supplied, the electric potential of the individual electrode 135 is temporarily made equal to that of the common electrode 134, and, after a predetermined length of time, returned to the predetermined electric potential. At the timing when the individual electrode 135 is made equal in electric potential to the common electrode 134, the actuator terminates the unimorph deformation, so that the ink is sucked to the pressure chamber 110. Then, at the timing when the electric potential is returned to the predetermined electric potential, the actuator causes the unimorph deformation again, which ejects the ink droplet from the ejection opening 108.

Figure 5:
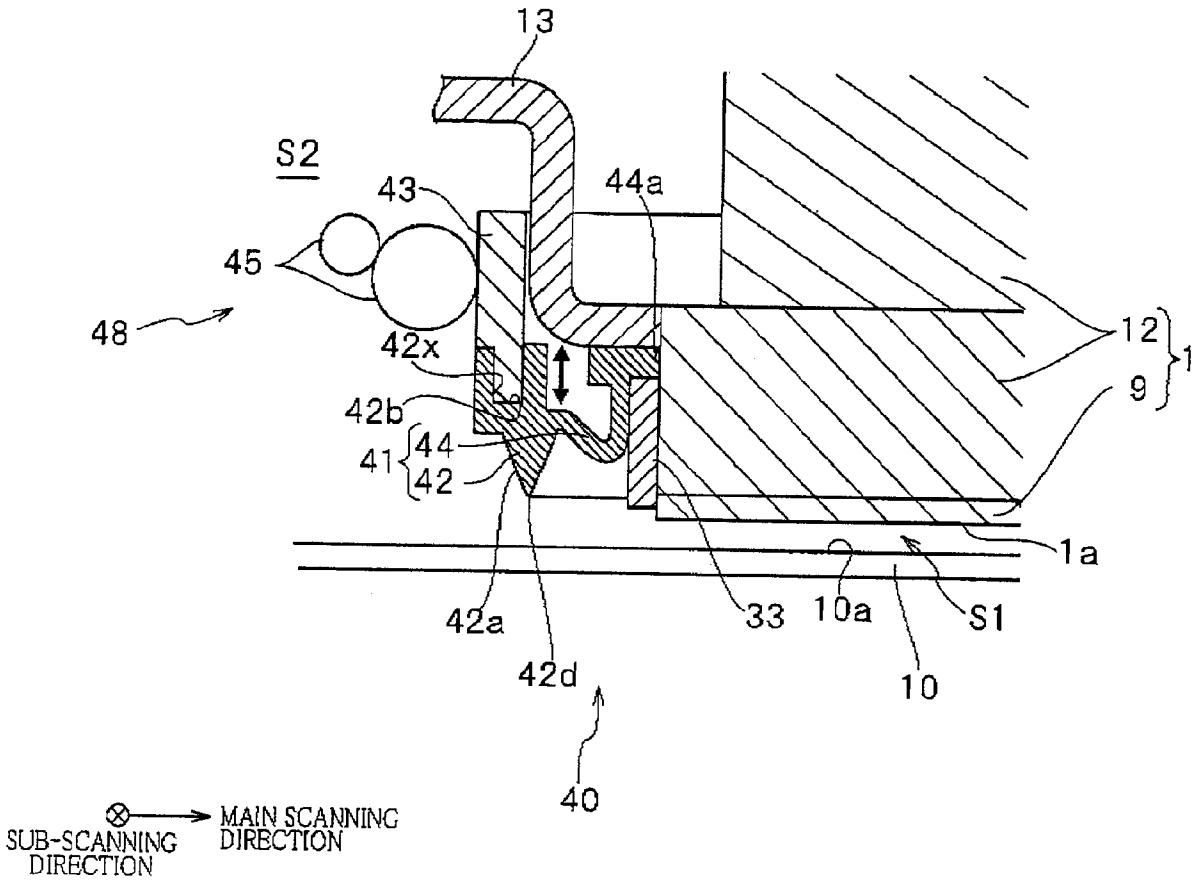
FIG. 5 is a partial cross-sectional view illustrating an area V enclosed by one-dot chain line in FIG. 4B.

There will be next explained structures of the head holder 13 and the capping mechanism 40 with reference to FIGS. 2, 4, and 5.

As illustrated in FIG. 5, the head holder 13 is a rigid-body frame formed of metal, for example, and supports side faces of the head 1 in its entire perimeter. The cap member 41 of the capping mechanism 40 is mounted on the head holder 13. Also, a side cover 33 is provided on the side faces of the head 1 so as to enclose the entire perimeter of the head 1. The side cover 33 is formed of resin and as illustrated in FIG. 5 expands on side faces of the channel unit 9 and the reservoir unit 12.

Here, contact portions of the head holder 13 and the head 1 are sealed with a sealant in their entire perimeter. Also, contact portions of the head holder 13 and the cap member 41 are fixed to each other with an adhesive in their entire perimeter.

The capping mechanism 40 includes: the cap member 41; a cap elevating and lowering mechanism 48 for elevating and lowering the cap member 41; a facing member 10; and a facing-member elevating and lowering mechanism 49 (see FIG. 7) for elevating and lowering the facing member 10. The cap member 41 is elongated in the main scanning direction so as to be capable of enclosing the ejection space S1 (i.e., the ejection openings 108) together with the facing member 10 and the ejection face 1*a*. The cap member 41 includes a lip member 42 and a diaphragm 44.

The lip member 42 is formed of an elastic material such as rubber and encloses the head 1 in plan view. The lip member 42 is provided outside the side cover 33. The lip member 42 includes: a base portion 42*x*; and a projecting portion 42*a* projecting from a lower face of the base portion 42*x*. The projecting portion 42*a* has a triangle shape in its cross section. Formed in an upper face of the base portion 42*x* is a recessed portion 42*b* in which a lower end of a movable member 43 which will be described below is fitted.

The diaphragm 44 is also formed of an elastic material such as rubber and encloses the head 1 in plan view. More specifically, the diaphragm 44 is a flexible thin-film member whose one end (i.e., outer circumferential end) is connected to an inner circumferential face of the lip member 42. The lip member 42 is integral with the diaphragm 44. An inner circumferential end of the diaphragm 44 is a close-contact portion 44*a*. The close-contact portion 44*a* has: an outer side face acting as a base portion for the thin-film member; an inner side face held in close contact with the side face of the head 1; an upper face held in close contact with a lower face of the head holder 13; and a lower face held in close contact with an upper end face of the side cover 33.

The cap elevating and lowering mechanism 48 includes the movable member 43, a plurality of gears 45, and an up/down motor, not shown. The movable member 43 is formed of a rigid material such as stainless steel and located outside the side cover 33 so as to enclose the head 1. The movable member 43 is engaged with one of the plurality of gears 45. When the controller 100 drives the up/down motor, the gears 45 are rotated to elevate or lower the movable member 43. In this movement, the base portion 42*x* is also moved upward or downward. As a result, a position of the projecting portion 42*a* (i.e., a distal end 42*d* of the lip member 42) relative to the ejection face 1*a* is changed vertically.

With the upward and downward movement of the movable member 43, the cap member 41 is selectively located at one of a contact position, illustrated in FIG. 4B, at which the cap member 41 is held in contact with an upper face 10*a* of the facing member 10 and a distant position, illustrated in FIG. 5, at which the cap member 41 is spaced apart from the upper face 10*a*. At the contact position, the distal end 42*d* of the lip member 42 can contact the upper face 10*a* of the facing member 10 located at a first position which will be described below. When the lip member 42 is brought into contact with the upper face 10*a* of the facing member 10 located at the first position, the ejection space S1 is switched to the capped state in which the ejection space S1 is isolated from the outside space S2. At the distant position, the ejection space S1 is in the uncapped state in which the ejection space S1 communicates with the outside space S2.

The facing member 10 is a glass plate having a rectangular planar shape which is one size larger than the lip member 42 in plan view. The upper face 10*a* has higher hydrophilicity than a surface of the lip member 42.

The facing-member elevating and lowering mechanism 49 elevates and lowers the facing member 10 between the first position and a second position. As illustrated in FIG. 4B, the first position is a position at which the facing member 10 is the nearest to the ejection face 1*a* among positions of the facing member 10. This first position corresponds to the contact position of the lip member 42 and is associated with the flushing operation and the capping operation. Here, in the present embodiment, a distance between the upper face 10*a* and the ejection face 1*a* is equal to a distance between the support face of the platens 6*a*, 6*b* and the ejection face 1*a* during the image recording. As illustrated in FIG. 4A, the second position is a position at which the distance between the upper face 10*a* and the ejection face 1*a* is greater than that at the first position. The facing member 10 is located at this second position during the image recording, and this second position is associated with the purging operation and an uncapping operation.

Figure 6A:
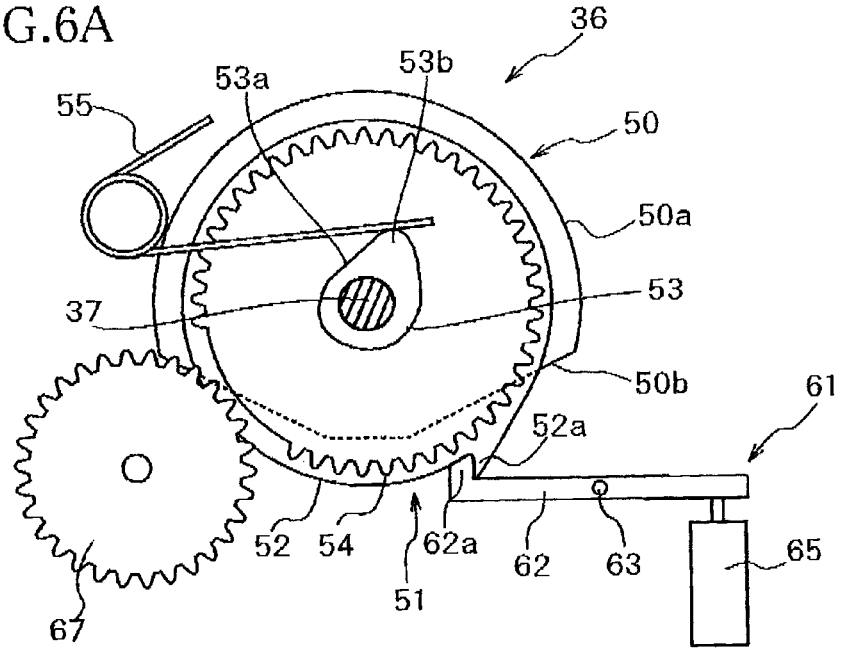
FIGS. 6A and 6B are side views each generally illustrating a sheet-supply mechanism of the printer in FIG. 1.
Figure 6B:
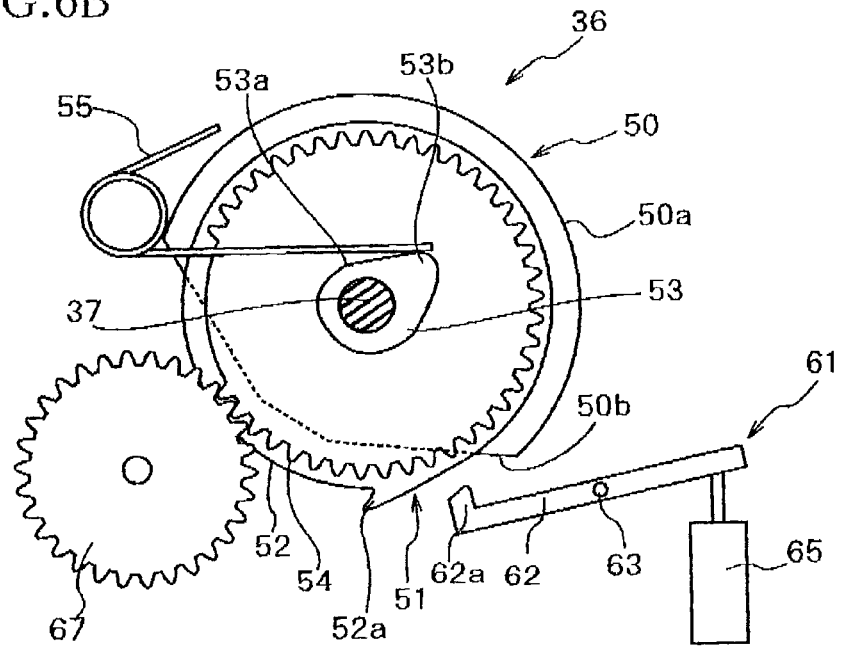

There will be next explained a structure of the sheet-supply mechanism 36 with reference to FIGS. 6A and 6B. The sheet-supply mechanism 36 includes a sheet-supply roller 50 and an intermittently rotating mechanism 51 for rotating the sheet-supply roller 50.

The sheet-supply roller 50 is rotatably supported by a rotation shaft 37 and has generally D shape in its cross section that is perpendicular to the rotation shaft 37. An outer circumferential face of the sheet-supply roller 50 is constituted by a contact face 50*a* contactable with the sheet P and a non-contact face 50*b* not contactable with the sheet P. The distance between the contact face 50*a* and the center of the sheet-supply roller 50 is the same at any position of the contact face 50*a*.

The intermittently rotating mechanism 51 is designed, in response to a sheet-supply command supplied from the controller 100, to cause the sheet-supply roller 50 to make one intermittent rotation clockwise in FIGS. 6A and 6B. The intermittently rotating mechanism 51 includes a first cam 52, a second cam 53, a sector gear 54, an urging spring 55, a solenoid switch 61, an input gear 67, and a sheet-supply drive motor 66 (see FIG. 7). The first cam 52, the second cam 53, the sector gear 54, and the sheet-supply roller 50 are rotated together about the rotation shaft 37.

An engaging projection 52*a* is provided on a portion of an outer circumferential face of the first cam 52. The second cam 53 has generally D shape in its cross section that is perpendicular to the rotation shaft 37. One end portion of a flat portion 53*a* of the D shape is a large-diameter portion 53*b*. The sector gear 54 is a gear with successive missing teeth which is rotated while meshed with the input gear 67 to which a motive force or a drive force is supplied and input from the sheet-supply drive motor 66. It is noted that a rotation shaft of the sheet-supply drive motor 66 is equipped with a rotation-speed detection device 98 (see FIG. 7) for detecting a rotation speed of the sheet-supply drive motor 66. The rotation-speed detection device 98 outputs the detected rotation speed of the sheet-supply drive motor 66 to the controller 100.

The solenoid switch 61 includes a seesaw lever 62 and an electromagnetic solenoid 65. The seesaw lever 62 is supported at its generally central position by a support shaft 63 so as to allow a seesaw motion of the seesaw lever 62. Formed on one end of the seesaw lever 62 is an engaging jaw 62*a* that can be engaged with the engaging projection 52*a* of the first cam 52. The electromagnetic solenoid 65 is connected to the other end of the seesaw lever 62. The electromagnetic solenoid 65 is switchable between its ON state and OFF state to move the seesaw lever 62 about the support shaft 63. When the electromagnetic solenoid 65 is in the OFF state, as illustrated in FIG. 6A, the seesaw lever 62 is located at an engaged position at which the engaging jaw 62*a* and the engaging projection 52*a* are engaged with each other. When the electromagnetic solenoid 65 is in the ON state, as illustrated in FIG. 6B, the seesaw lever 62 is located at a disengaged position at which the engaging jaw 62*a* and the engaging projection 52*a* are disengaged from each other.

Here, when the engaging jaw 62*a* and the engaging projection 52*a* are engaged with each other, the missing-teeth portion of the sector gear 54 faces the input gear 67. In this state, the motive force is not transmitted from the input gear 67 to the sector gear 54. Also, in this state, the non-contact face 50*b* of the sheet-supply roller 50 faces the sheet-supply tray 35 (i.e., the sheet P).

The urging spring 55 is a torsion coil spring that urges the large-diameter portion 53*b* of the second cam 53. Upon the disengagement between the engaging jaw 62*a* and the engaging projection 52*a*, this urging spring 55 forces the second cam 53 to rotate, causing the sector gear 54 to rotate to the position at which the sector gear 54 is meshed with the input gear 67.

There will be next explained operations of the sheet-supply mechanism 36. When the electromagnetic solenoid 65 is in the OFF state, as illustrated in FIG. 6A, the seesaw lever 62 is located at the engaged position, so that the engaging jaw 62*a* and the engaging projection 52*a* are engaged with each other. That is, the motive force is not supplied to the sheet-supply roller 50, so that the sheet P is not supplied.

Then, when the electromagnetic solenoid 65 is temporarily switched to the ON state in response to the sheet-supply command supplied from the controller 100, the engaging jaw 62*a* and the engaging projection 52*a* are disengaged from each other, causing the urging force of the urging spring 55 to rotate the sector gear 54 to the position at which the sector gear 54 is meshed with the input gear 67. As a result, the motive force is transmitted from the input gear 67 to the sector gear 54, and the sector gear 54 is rotated. This rotation rotates the sheet-supply roller 50 to supply the uppermost sheet P in the sheet-supply tray 35 to the upstream conveyance path R1. It is noted that the electromagnetic solenoid 65 is switched to the OFF state before one rotation of the sector gear 54 is completed.

Thereafter, upon the completion of the one rotation of the sector gear 54, the engaging projection 52*a* and the engaging jaw 62*a* are engaged with each other again. As a result, the rotation of the sector gear 54 is stopped, which stops the rotation of the sheet-supply roller 50.

Figure 7:
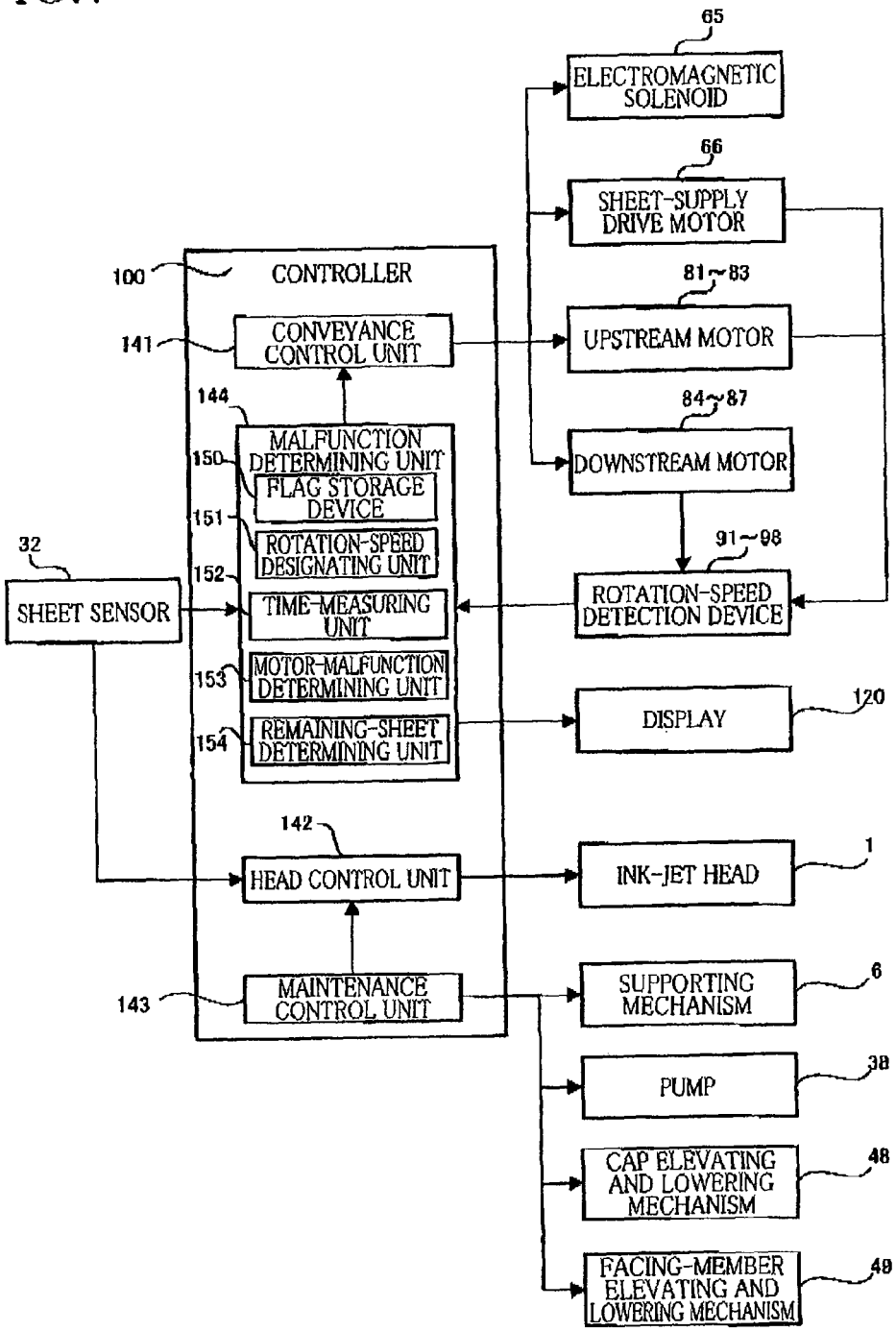
FIG. 7 is a block diagram illustrating a general configuration of a controller of the printer in FIG. 1.

There will be next explained the controller 100 with reference to FIG. 7. The controller 100 includes: a central processing unit (CPU); a read only memory (ROM) rewritably storing programs executable by the CPU and data used for these programs; and a random access memory (RAM) for temporarily storing the data in the execution of the programs. The controller 100 includes various functional sections or units which are constituted by cooperation of these hardware and software in the ROM with each other. As illustrated in FIG. 7, the controller 100 includes a conveyance control unit 141, a head control unit 142, a maintenance control unit 143, and a malfunction determining unit 144.

The conveyance control unit 141 controls the upstream motors 81-83, the downstream motors 84-87, and the rotation speed of the sheet-supply drive motor 66 in the image recording such that the sheet P is conveyed through the conveyance path R at a predetermined conveying speed. The conveyance control unit 141 also controls the ON state and the OFF state of the electromagnetic solenoid 65. Specifically, the conveyance control unit 141 outputs the sheet-supply command to the electromagnetic solenoid 65 to temporarily switch the electromagnetic solenoid 65 to the ON state. As a result, the sheet-supply roller 50 is rotated once to supply the uppermost sheet P in the sheet-supply tray 35.

The head control unit 142 controls the head 1 to eject the ink onto the sheet P in the image recording on the basis of the image data contained in the recording command supplied from the external device. The ink ejection timing is determined on the basis of a sense of a leading end of the sheet P by the sheet sensor 32. Specifically, the ink ejection timing is the timing when a predetermined length of time has passed after the sense of the sheet P. It is noted that this predetermined length of time is a time obtained by dividing, by the conveying speed of the sheet P, a distance along the conveyance path R between the most upstream one of the ejection openings 108 and the leading end of the sheet P when the leading end of the sheet P is sensed by the sheet sensor 32.

The maintenance control unit 143 controls the head 1 in the flushing operation, the purging operation, and the capping operation by controlling the supporting mechanism 6, the pump 38, the cap elevating and lowering mechanism 48, the facing-member elevating and lowering mechanism 49, and the head control unit 142.

The malfunction determining unit 144 controls the conveyance control unit 141 in the malfunction-existence determining operation to control the upstream motors 81-83, the downstream motors 84-87, and the rotation speed of the sheet-supply drive motor 66. There will be explained the malfunction determining unit 144 in detail.

The malfunction determining unit 144 includes a flag storage device 150, a rotation-speed designating unit 151, a time-measuring unit 152, a motor-malfunction determining unit 153, and a remaining-sheet determining unit 154.

The flag storage device 150 stores: a motor check flag that indicates whether or not the motor-malfunction determining unit 153 has finished malfunction-existence determination for the conveyor mechanism 2; and a remaining-sheet flag that indicates whether there is a sheet P remaining in the upstream conveyance path R1 or not. This motor check flag has an ON state and an OFF state, and the ON state indicates that the malfunction-existence determination for the conveyor mechanism 2 is finished while the OFF state indicates that the malfunction-existence determination for the conveyor mechanism 2 has not been finished. Also, the remaining-sheet flag has an ON state and OFF state, and the ON state indicates that there is a sheet P remaining in the upstream conveyance path R1, the OFF state indicates that there is no sheet P remaining in the upstream conveyance path R1. It is noted that an initial state of each of the motor check flag and the remaining-sheet flag is the OFF state.

The rotation-speed designating unit 151 stores in advance predetermined rotation speeds for the upstream motors 81-83, the downstream motors 84-87, and the sheet-supply drive motor 66. The rotation-speed designating unit 151 controls the conveyance control unit 141 in the malfunction-existence determining operation to control the components of the conveyor mechanism 2 (i.e., the upstream motors 81-83, the downstream motors 84-87, and the sheet-supply drive motor 66) to be continuously driven at their respective predetermined rotation speeds. Also, the rotation-speed designating unit 151 always keeps the electromagnetic solenoid 65 in the OFF state in the malfunction-existence determining operation.

Here, the predetermined rotation speeds of the upstream motors 81-83, the downstream motors 84-87, and the sheet-supply drive motor 66 which are stored in the rotation-speed designating unit 151 are lower than their respective rotation speeds in the image recording. That is, a motive force applied to the conveyor mechanism 2 is less in the malfunction-existence determining operation than in the image recording. Thus, the conveying speed of the sheet P can be slow in the malfunction-existence determining operation, resulting in a shorter braking distance of sheet P when the driving of the conveyor mechanism 2 is stopped by the malfunction determining unit 144.

The time-measuring unit 152 measures a length of time elapsed from the beginning of the driving of the conveyor mechanism 2 which is controlled by the rotation-speed designating unit 151.

The motor-malfunction determining unit 153 monitors the rotation speeds of the motors 66, 81-87 detected and output by rotation-speed detection devices 91-98 to determine whether or not the conveyor mechanism 2 normally continues to be driven for a first predetermined length of time as one example of a first period. Specifically, when the rotation speeds of the motors 66, 81-87 fall within a predetermined range stored in the rotation-speed designating unit 151 until the first predetermined length of time has passed from the beginning of the driving of the conveyor mechanism 2, the motor-malfunction determining unit 153 determines that there is no malfunction in the conveyor mechanism 2. On the other hand, when the rotation speeds of the motors 66, 81-87 fall outside the predetermined range stored in the rotation-speed designating unit 151 before the first predetermined length of time has passed from the beginning of the driving of the conveyor mechanism 2, the motor-malfunction determining unit 153 determines that there is a malfunction in the conveyor mechanism 2. It is noted that when the motor-malfunction determining unit 153 finishes determining that the continuous driving of the conveyor mechanism 2 for the first predetermined length of time is normal, the motor check flag stored in the flag storage device 150 is switched to the ON state.

The remaining-sheet determining unit 154 determines whether there is a sheet P remaining in the upstream, conveyance path R1 or not. Here, there is a situation where the electric power supply to the printer 101 is stopped due to, e.g., a power failure, with the sector gear 54 meshed with the input gear 67 as illustrated in FIG. 6B. When the electric power supply is thereafter restarted in this situation, the motive force of the sheet-supply drive motor 66 may be transmitted to the sheet-supply roller 50 even though the controller 100 has not output the sheet-supply command to the electromagnetic solenoid 65, leading to a case where the sheet P accommodated in the sheet-supply tray 35 is supplied to the upstream conveyance path R1 and remains therein. That is, there is a situation in which the type, e.g., the sheet size, of the sheet P remaining in the upstream conveyance path R1 is different from that of the sheet P for the image recording. In this case, there is a need to convey the sheet P remaining in the upstream conveyance path R1 to the downstream conveyance path R2 before the image recording.

In the present embodiment, the determination of whether there is a sheet P remaining in the upstream conveyance path R1 or not is made in the capped state. There will be explained operations of the remaining-sheet determining unit 154 for determining whether there is a sheet P remaining in the upstream conveyance path R1 or not.

When the sheet P is not sensed by the sheet sensor 32 before a second predetermined length of time as one example of a second period has passed from the beginning of the driving of the conveyor mechanism 2, the remaining-sheet determining unit 154 determines that there is no sheet P remaining in the upstream conveyance path R1.

On the other hand, when the sheet P is sensed by the sheet sensor 32, the remaining-sheet determining unit 154 determines that there is a sheet P remaining in the upstream conveyance path R1. The remaining-sheet determining unit 154 then switches the remaining-sheet flag stored in the flag storage device 150 to the ON state and stops the driving of the conveyor mechanism 2. Also, the time-measuring unit 152 stores the measured time extending from the beginning of the driving of the conveyor mechanism 2 to the stop of the driving of the conveyor mechanism 2. Here, the second predetermined length of time is a time obtained by dividing, by the conveying speed of the sheet P, a distance from the sheet-supply roller 50 to the sensing position of the sheet sensor 32 along the conveyance path R.

Figure 8:
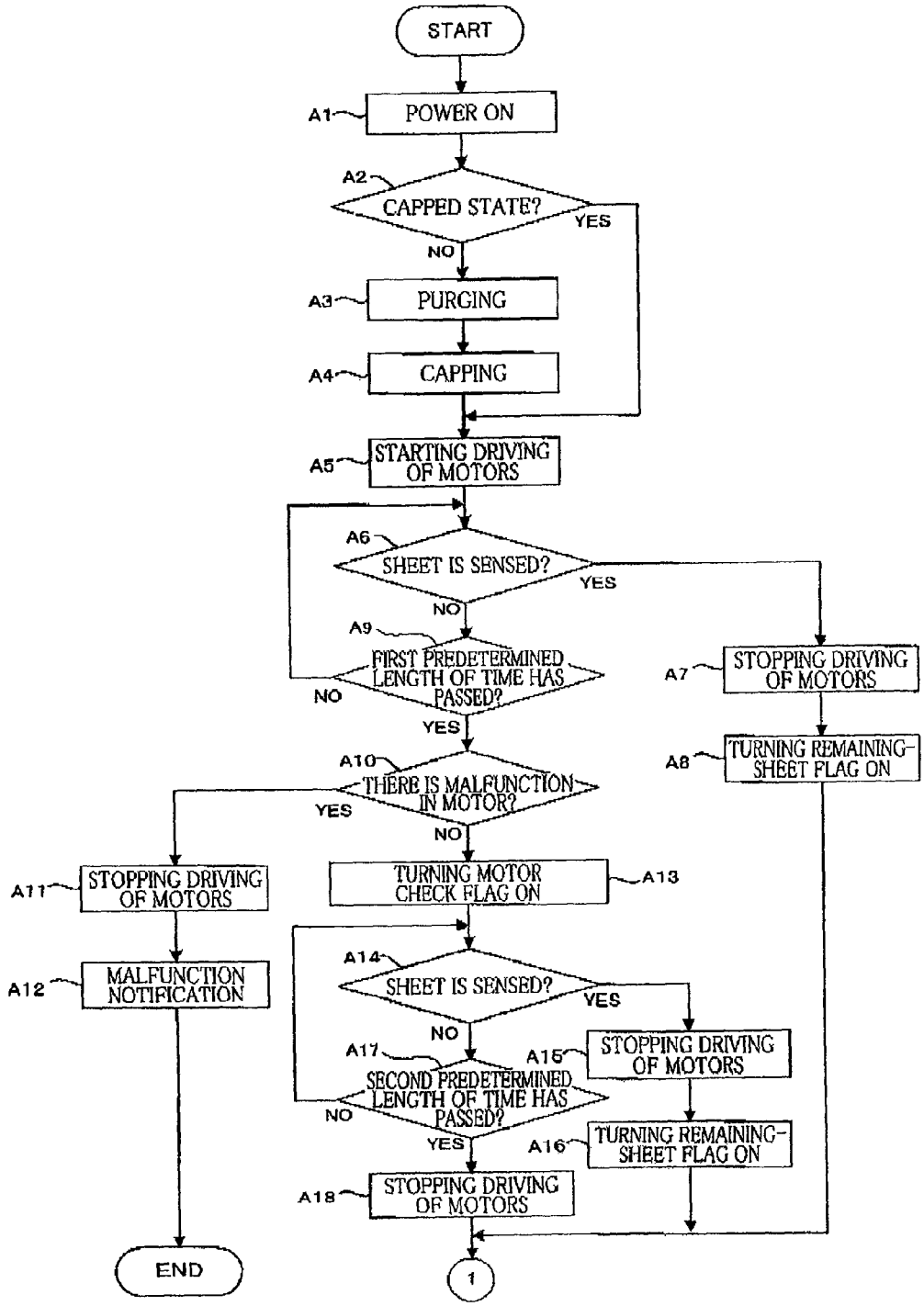
FIG. 8 is a flow chart illustrating a malfunction-existence determining operation executed by a controller of the printer in FIG. 1.
Figure 9:
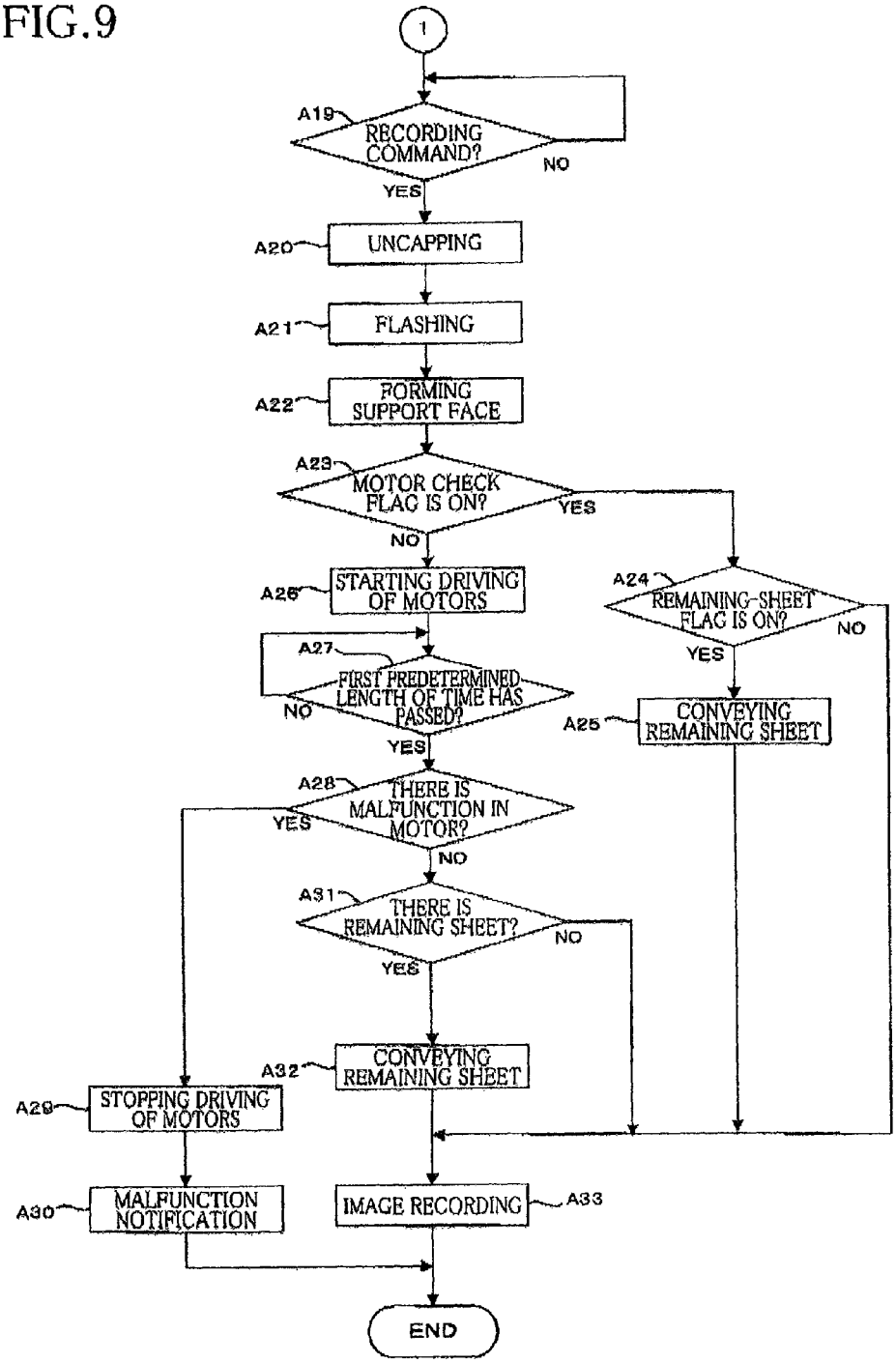
FIG. 9 is a flow chart illustrating the malfunction-existence determining operation executed by the controller of the printer in FIG. 1.

There will be next explained, with reference to FIGS. 8 and 9, operations (an operation flow) of the printer 101 related to the malfunction-existence determining operation. It is assumed that an initial state of this flow is the state in which the electric power supply to the printer 101 is stopped due to, e.g., a power failure. Also, the motor check flag and the remaining-sheet flag stored in the flag storage device 150 are in their respective initial states.

This flow begins with step A1 (hereinafter "step" is omitted where appropriate"), at which, when a user pushes a power switch, not shown, to turn on a power source of the printer 101, the controller 100 receives a power-on signal from the power switch. Upon receipt of this signal, the maintenance control unit 143 at A2 determines whether the ejection space S1 is in the capped state or not on the basis of the positions of the facing member 10 and the capping mechanism 40. When the maintenance control unit 143 determines that the ejection space S1 is in the capped state (A2: YES), this flow goes to A5. On the other hand, when the maintenance control unit 143 determines that the ejection space S2 is not in the capped state, that is, the ejection space S1 is in the uncapped state (A2: NO), the maintenance control unit 143 at A3 controls the supporting mechanism 6 to pivot to the open position and then controls the pump 38 to perform the purging operation. Then at A4, the maintenance control unit 143 controls the cap elevating and lowering mechanism 48 and the facing-member elevating and lowering mechanism 49 to move the cap member 41 and the facing member 10 to the contact position and the first position, respectively. Thus, the ejection space S1 is switched to the capped state in which the ejection space S1 is isolated from the outside space S2. Upon completion of the processing at A4, this flow goes to A5.

At A5, the malfunction determining unit 144 starts the malfunction-existence determining operation. Specifically, the rotation-speed designating unit 151 starts driving the conveyor mechanism 2 (i.e., the upstream motors 81-83, the downstream motors 84-87, and the sheet-supply drive motor 66). When the driving of the conveyor mechanism 2 is started by the rotation-speed designating unit 151, the time-measuring unit 152 starts to measure an elapsed time, and the motor-malfunction determining unit 153 starts to monitor the rotation speeds of the motors 66, 81-87 detected and output by rotation-speed detection devices 91-98.

Then, the remaining-sheet determining unit 154 at A6 determines whether the sheet sensor 32 has sensed the sheet P or not. When the remaining-sheet determining unit 154 determines that the sheet sensor 32 has sensed the sheet P (A6: YES), the remaining-sheet determining unit 154 at A7 stops the driving of the conveyor mechanism 2. This can prevent the sheet P from colliding against the capping mechanism 40. Also, the conveying speed of the sheet P is slower in this operation than in the image recording as described above, resulting in reduction in a possibility that the sheet P collides against the capping mechanism 40.

Upon completion of the processing at A7, the remaining-sheet determining unit 154 at A8 switches the remaining-sheet flag stored in the flag storage device 150 to the ON state, and the time-measuring unit 152 stores the measured time extending from the beginning of the driving of the conveyor mechanism 2 to the stop of the driving of the conveyor mechanism 2. Upon completion of the processing at A5, this flow goes to A19.

On the other hand, when the remaining-sheet determining unit 154 determines that the sheet sensor 32 has not sensed the sheet P (A6: NO), the time-measuring unit 152 at A9 determines whether the measured time has reached the first predetermined length of time or not. When the time-measuring unit 152 determines that the measured time has not reached the first predetermined length of time (A9: NO), this flow returns to A6.

On the other hand, when the time-measuring unit 152 determines that the measured time has reached the first predetermined length of time (A9: YES), the motor-malfunction determining unit 153 at A10 determines whether there is a malfunction in the conveyor mechanism 2 or not. When the motor-malfunction determining unit 153 determines that there is a malfunction in the conveyor mechanism 2 (A10: YES), the motor-malfunction determining unit 153 at A11 stops the driving of the conveyor mechanism 2 and at A12 controls the display 120 to display thereon a screen indicating that there is a malfunction in the conveyor mechanism 2. Thus, the user can visually recognize the presence of a malfunction in the conveyor mechanism 2.

On the other hand, when the motor-malfunction determining unit 153 at A10 determines that there is no malfunction in the conveyor mechanism 2 (A10: NO), the controller 100 at A13 switches the motor check flag to the ON state, and this flow goes to A14.

The remaining-sheet determining unit 154 at A14 determines whether the sheet sensor 32 has sensed the sheet P or not. When the remaining-sheet determining unit 154 determines that the sheet sensor 32 has sensed the sheet P (A14: YES), the remaining-sheet determining unit 154 at A15 stops the driving of the conveyor mechanism 2 and at A16 switches the remaining-sheet flag stored in the flag storage device 150 to the ON state. Also, the time-measuring unit 152 stores the measured time extending from the beginning of the driving of the conveyor mechanism 2 to the stop of the driving of the conveyor mechanism 2. Upon completion of the processing at A16, this flow goes to A19.

On the other hand, when the remaining-sheet determining unit 154 at A14 determines that the sheet sensor 32 has not sensed the sheet P (A14: NO), the time-measuring unit 152 at A17 determines whether the measured time has reached the second predetermined length of time or not. When the time-measuring unit 152 determines that the measured time has not reached the second predetermined length of time (A17: NO), this flow returns to A14. On the other hand, when the time-measuring unit 152 determines that the measured time has reached the second predetermined length of time (A17: YES), the remaining-sheet determining unit 154 determines that there is no sheet P remaining in the upstream conveyance path R1, and the controller 100 at A18 stops the driving of the conveyor mechanism 2, and this flow goes to A19.

The controller 100 at A19 determines whether the controller 100 has received the recording command from the external device or not. When the controller 100 determines that the controller 100 has not received the recording command (A19: NO), this flow repeats the processing at A19 to wait for the recording command. On the other hand, when the controller 100 determines that the controller 100 has received the recording command (A19: YES), the maintenance control unit 143 at A20 controls the cap elevating and lowering mechanism 48 to move the cap member 41 to the distant position. As a result, the ejection space 81 is switched to the uncapped state in which the ejection space S1 communicates with the outside space 82. Then at A21, the maintenance control unit 143 controls the head 1 to perform the flushing operation. The maintenance control unit 143 at A22 controls the supporting mechanism 6 and the facing-member elevating and lowering mechanism 49 to move the facing member 10 and the supporting mechanism 6 to the second position and the support-face forming position, respectively.

The malfunction determining unit 144 at A23 determines whether the motor check flag stored in the flag storage device 150 is in the ON state or not. When the malfunction determining unit 144 determines that the motor check flag is in the ON state (A23: YES), the malfunction determining unit 144 determines that the malfunction-existence determination for the conveyor mechanism 2 has been completed. Then at A24, the malfunction determining unit 144 determines whether the remaining-sheet flag stored in the flag storage device 150 is in the ON state or not. When the malfunction determining unit 144 determines that the remaining-sheet flag is not in the ON state, that is, the remaining-sheet flag is in the OFF state (A24: NO), the malfunction determining unit 144 determines that there is no sheet P remaining in the upstream conveyance path R1, and this flow goes to A33.

On the other hand, when the malfunction determining unit 144 determines that the remaining-sheet flag is in the ON state (A24: YES), the malfunction determining unit 144 at A25 drives the conveyor mechanism 2 for a third predetermined length of time to convey the sheet P remaining in the upstream conveyance path R1 to the downstream conveyance path R2. As a result, there is no sheet P remaining in the upstream conveyance path R1 at the beginning of the image recording. Here, the third predetermined length of time is obtained in the following manner. First, the controller 100 obtains a conveyance-path distance that is the sum of the length of the sheet P in the conveying direction and a distance from the sheet-supply roller 50 to an upstream end of the downstream conveyance path R2 along the conveyance path R. The controller 100 then calculates a sheet-discharge required time by dividing the conveyance-path distance by the conveying speed of the sheet P. The third predetermined length of time is a time obtained by subtracting the measured time stored in the time-measuring unit 152 from the sheet-discharge required time. Upon completion of the processing at A25, this flow goes to A33.

When the malfunction determining unit 144 at A23 determines that the motor check flag is not in the ON state, that is, the motor check flag is in the OFF state (A23: NO), the rotation-speed designating unit 151 at A26 starts the driving of the conveyor mechanism 2 to start the malfunction-existence determining operation for the conveyor mechanism 2. Also, the time-measuring unit 152 starts to measure a length of time elapsed from the beginning of the driving of the conveyor mechanism 2 which is controlled by the rotation-speed designating unit 151, and the motor-malfunction determining unit 153 starts to monitor the rotation speeds of the motors 66, 81-87 detected and output by rotation-speed detection devices 91-98.

Then at A27, the time-measuring unit 152 determines whether the measured time has reached the first predetermined length of time or not. When the time-measuring unit 152 determines that the measured time has not reached the first predetermined length of time (A27: NO), this flow repeats the processing at A27. When the time-measuring unit 152 determines that the measured time has reached the first predetermined length of time (S27: YES), the motor-malfunction determining unit 153 at A28 determines whether there is a malfunction in the conveyor mechanism 2 or not. When the motor-malfunction determining unit 153 determines that there is a malfunction in the conveyor mechanism 2 (A28: YES), the motor-malfunction determining unit 153 at A29 stops the driving of the conveyor mechanism 2 and at A30 controls the display 120 to display thereon the screen indicating that there is a malfunction in the conveyor mechanism 2.

On the other hand, when the motor-malfunction determining unit 153 at A28 determines that there is no malfunction in the conveyor mechanism 2 (A28: NO), the malfunction, determining unit 144 at A31 determines whether or not there is a possibility that a sheet P remains in the upstream conveyance path R1. Specifically, when a length of time obtained by adding the first predetermined length of time to the measured time stored in the time-measuring unit 152 is shorter than the above-described sheet-discharge required time, the malfunction determining unit 144 determines that there is a possibility that a sheet P remains in the upstream conveyance path R1. On the other hand, when the length of time obtained by adding the first predetermined length of time to the measured time stored in the time-measuring unit 152 is longer than the sheet-discharge required time, the malfunction determining unit 144 determines that there is no possibility that a sheet P remains in the upstream conveyance path R1. When the malfunction determining unit 144 determines that there is no possibility that a sheet P remains in the upstream conveyance path R1 (A31: NO), this flow goes to A33.

On the other hand, when the malfunction determining unit 144 determines that there is a possibility that a sheet P remains in the upstream conveyance path R1 (A31: YES), the malfunction determining unit 144 at A32 drives the conveyor mechanism 2 for a fourth predetermined length of time to convey the sheet P remaining in the upstream conveyance path R1 to the downstream conveyance path R2. Here, the fourth predetermined length of time is a time obtained by subtracting, from the above-described sheet-discharge required time, the length of time obtained by adding the first predetermined length of time to the measured time stored in the time-measuring unit 152. Upon completion of the processing at A32, this flow goes to A33.

At A33, the head control unit 142 and the conveyance control unit 141 respectively control the head 1 and the conveyor mechanism 2 to perform the image recording, and this flow ends.

According to the present embodiment described above, the determination of whether there is a malfunction in the conveyor mechanism 2 or not can be performed when the ejection space S1 is in the capped state. This makes it possible to shorten a length of time from the beginning of the uncapping to the beginning of the image recording on the sheet P. Also, when the sheet sensor 32 senses the sheet P at the sensing position on, the upstream conveyance path R1, the driving of the conveyor mechanism 2 is stopped, resulting in reduction in a possibility that the sheet P collides against the capping mechanism 40.

Also, even in a case where the determination of whether there is a malfunction in the conveyor mechanism 2 or not cannot be performed when the ejection space S1 is in the capped state, the malfunction-existence determining operation is performed after the ejection space S1 is switched to the uncapped state and before the beginning of the image recording. Thus, it is possible to reliably determine whether there is a malfunction in the conveyor mechanism 2 or not.

Also, the determination of whether there is a sheet P remaining in the upstream conveyance path R1 or not can be performed when the ejection space S1 is in the capped state. This makes it possible to shorten the length of time from the beginning of the uncapping to the beginning of the image recording on the sheet P.

Also, the sensing position at which the sheet P is sensed by the sheet sensor 32 is located at the downstream end portion of the upstream conveyance path R1 in the conveying direction D. This increases a possibility that the determination of whether there is a malfunction in the conveyor mechanism 2 or not is performed when the ejection space S1 is in the capped state.

Figure 10:
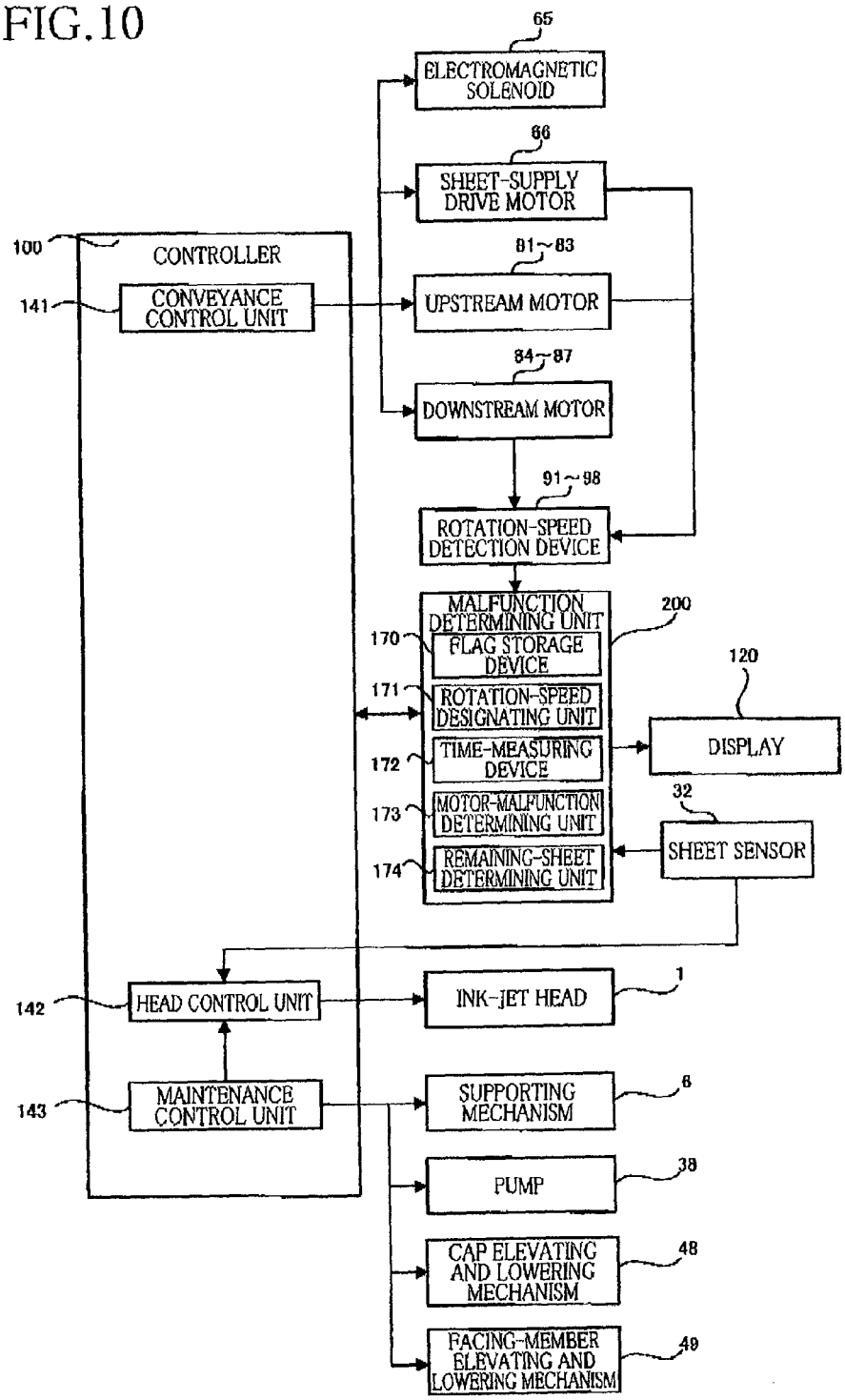
FIG. 10 is a view, corresponding to FIG. 7, for explaining a modification.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, the determination of whether there is a malfunction in the conveyor mechanism 2 or not is executed by the malfunction determining unit 144 of the controller 100 in the above-described embodiment. Nevertheless, as illustrated in FIG. 10, the determination may be executed by a malfunction determining unit 200 as one example of a determination unit that is a control system different from the controller 100 and communicably coupled thereto. In this case, for example, the malfunction determining unit 200 includes a flag storage device 170, a rotation-speed designating unit 171, a time-measuring unit 172, a motor-malfunction determining unit 173, and a remaining-sheet determining unit 174 respectively corresponding to the flag storage device 150, the rotation-speed designating unit 151, the time-measuring unit 152, the motor-malfunction determining unit 153, and the remaining-sheet determining unit 154.

Also, the rotation speeds of the motors 66, 81-87 are determined to be lower in the malfunction-existence determining operation for the conveyor mechanism 2 in the uncapped state than in the image recording in the above-described embodiment. Nevertheless, the predetermined rotation speed may not be lower in the malfunction-existence determining operation in the uncapped state than in the image recording because there is no risk of collision of the sheet P against the capping mechanism 40 in the uncapped state.

Also, while the distal end 42*d* of the lip member 42 is movable upward and downward in the above-described embodiment, the present invention is not limited to this configuration. For example, the printer 101 may be configured such that the distal end 42*d* of the lip member 42 is immovably fixed to the head holder 13, and the position of the distal end 42*d* of the lip member 42 relative to the ejection face 1*a* is fixed. This configuration may be employed as long as the distal end 42*d* of the lip member 42 is held in contact with the facing member 10 when the facing member 10 is located at the contact position. Also, the printer 101 may be configured such that the cap member 41 is provided on the facing member 10, that is, the capping mechanism is not provided on a head side.

Also, when the sheet P is sensed by the sheet sensor 32 in the malfunction-existence determining operation with the ejection space S1 being in the capped state, the drivings of the conveyor roller pairs 25-28 (i.e., the downstream motors 84-87) are stopped in the above-described embodiment, but the drivings of the conveyor roller pairs 25-28 may not be stopped. That is, the determination of whether there is a malfunction in the conveyor roller pairs 25-28 or not may be executed with the ejection space S1 being in the capped state. In this configuration, when there is a malfunction in the conveyor roller pairs 25-28, the user can speedily recognize the malfunction.

Also, in the above-described embodiment, the first predetermined length of time for which the conveyor mechanism 2 is driven to determine whether there is a malfunction in the conveyor mechanism 2 or not is shorter than the second predetermined length of time for which the conveyor mechanism 2 is driven to determine whether there is a sheet P remaining in the upstream conveyance path R1 or not, but the present invention is not limited to this configuration. For example, the first predetermined length of time may be longer than the second predetermined length of time.

It is noted that, while the operation flow related to the malfunction-existence determining operation illustrated in FIGS. 8 and 9 is executed by the controller 100 in response to the switching of the power source of the printer 101 from the OFF state to the ON state in the above-described embodiment, the operation flow related to the malfunction-existence determining operation may be executed in any case instead of the case where the power source of the printer 101 has been switched to the ON state. For example, when the malfunction-existence determining operation for the conveyor mechanism 2 is executed in the state in which the power source of the printer 101 is in the ON state, the processings at A2 and subsequent steps in FIGS. 8 and 9 may be executed by the controller 100. Also in this case, in a case where the ejection space S1 is in the capped state when the controller 100 starts the malfunction-existence determining operation (at any timing between the determination of the controller 100 for executing the malfunction-existence determining operation and the beginning of driving the motors of the conveyor mechanism 2 by the controller 100 for starting the malfunction-existence determining operation), the controller 100 executes the malfunction-existence determining operation while keeping the capped state continued from the timing without switching the capped state to the uncapped state. As a result, the malfunction-existence determining operation can be completed early when compared with a case where the malfunction-existence determining operation is performed after the capped state is switched to the uncapped state.

Also, while the controller 100 is configured by the single CPU in the above-described embodiment, the controller 100 may be configured by a plurality of CPUs, an application-specific integrated circuit (ASIC), or a combination of the CPU(s) and the ASIC.

The present invention is also applicable to a line printer and a serial printer and applicable not only to the printer but also to devices such as a facsimile machine and a copying machine. Also, the present invention is applicable to a liquid ejection apparatus configured to eject liquid other than the ink to perform the recording. The recording medium is not limited to the sheet P, and various recordable media may be used. The present invention may be applied to a liquid ejection apparatus of any ink ejection method. For example, the piezoelectric elements are used in the present embodiment, but various methods may be used such as a resistance heating method and an electrostatic capacity method.

What is claimed is:

1. A liquid ejection apparatus comprising:

a liquid ejection head comprising an ejection face in which a plurality of ejection openings are formed, the liquid ejection head being configured to eject liquid toward a recording medium through the plurality of ejection openings, an ejection space being opposite the ejection face;

a capping mechanism configured to switch a state of the ejection space between a capped state in which the ejection space is substantially isolated from an ambient space of the ejection space and an uncapped state in which the ejection space communicates with the ambient space of the ejection space;

a conveyor mechanism configured to convey the recording medium along a conveyance path;

a recording-medium sensing device configured to sense whether the recording medium is present at a sensing position located on an upstream portion of the conveyance path, the upstream portion being located upstream of the ejection space; and a controller configured to:

control the capping mechanism and the conveyor mechanism;

execute a first determination of whether the conveyor mechanism is normal, the first determination being based on driving of the conveyor mechanism for a first period extending from a timing when the driving of the conveyor mechanism is started with the ejection space being in the capped state; and when the recording medium is sensed by the recording-medium sensing device within the first period, stop the driving of the conveyor mechanism even before the first period passes from the timing when the driving of the conveyor mechanism is started wherein the controller is configured to determine whether the state of the ejection space is the capped state or the uncapped state before the driving of the conveyor mechanism is started, and wherein the controller is configured to, when the state of the ejection space is the capped state before the driving of the conveyor mechanism is started, start the driving the conveyor mechanism with the ejection space being in the capped state.

2. The liquid ejection apparatus according to claim 1, wherein the controller is configured to execute the first determination when the recording medium is not sensed by the recording-medium sensing device during the first period, and wherein the controller is configured not to execute the first determination when the recording medium is sensed by the recording-medium sensing device within the first period.

3. The liquid ejection apparatus according to claim 1, wherein the controller is configured to, when the controller determines that the state of the ejection space is the capped state upon detecting that a power source of the liquid ejection apparatus is switched from an OFF state to an ON state, execute the first determination before the controller controls the capping mechanism to switch the state of the ejection space to the uncapped state from the capped state.

4. The liquid ejection apparatus according to claim 1, wherein the controller is configured to, when the recording medium is sensed by the recording-medium sensing device before the first period passes from the timing when the driving of the conveyor mechanism is started, execute another determination of whether the conveyor mechanism is normal based on the driving of the conveyor mechanism for the first period from a timing when the driving of the conveyor mechanism is started with the ejection space being in the uncapped state, said another determination being executed after the controller controls the capping mechanism to switch the state of the ejection space to the uncapped state and before the controller controls the liquid ejection head to eject the liquid onto the recording medium.

5. The liquid ejection apparatus according to claim 1, wherein the controller is configured to control the conveyor mechanism such that a motive force transmitted to the conveyor mechanism when the ejection space is in the capped state is less than a motive force transmitted to the conveyor mechanism when the liquid ejection head ejects the liquid onto the recording medium.

6. The liquid ejection apparatus according to claim 1, wherein the sensing position is located on a downstream end portion of the upstream portion of the conveyance path.

7. A method of controlling a liquid ejection apparatus comprising: a liquid ejection head comprising an ejection face in which a plurality of ejection openings are formed, the liquid ejection head being configured to eject liquid toward a recording medium through the plurality of ejection openings, an ejection space being opposite the ejection face; a capping mechanism configured to switch a state of the ejection space between a capped state in which the ejection space is substantially isolated from an ambient space of the ejection space and an uncapped state in which the ejection space communicates with the ambient space of the ejection space; a conveyor mechanism configured to convey the recording medium along a conveyance path; and a recording-medium sensing device configured to sense whether the recording medium is present at a sensing position located on an upstream portion of the conveyance path, the upstream portion being located upstream of the ejection space, the method comprising:

executing a first determination of whether the conveyor mechanism is normal, based on driving of the conveyor mechanism for a first period extending from a timing when the driving of the conveyor mechanism is started with the ejection space being in the capped state; and when the recording medium is sensed by the recording-medium sensing device within the first period, stopping the driving of the conveyor mechanism even before the first period passes from the timing when the driving of the conveyor mechanism is started determining whether the state of the ejection space is the capped state or the uncapped state before the driving of the conveyor mechanism is started, and when it is determined that the state of the ejection space is the capped state before the driving of the conveyor mechanism is started, starting the driving of the conveyor mechanism with the ejection space being in the capped state.

8. A liquid ejection apparatus comprising:

a liquid ejection head comprising an ejection face in which a plurality of ejection openings are formed, the liquid ejection head being configured to eject liquid toward a recording medium through the plurality of ejection openings, an ejection space being opposite the ejection face;

a capping mechanism configured to switch a state of the ejection space between a capped state in which the ejection space is substantially isolated from an ambient space of the ejection space and an uncapped state in which the ejection space communicates with the ambient space of the ejection space;

a conveyor mechanism configured to convey the recording medium along a conveyance path;

a recording-medium sensing device configured to sense whether the recording medium is present at a sensing position located on an upstream portion of the conveyance path, the upstream portion being located upstream of the ejection space; and a controller configured to:

control the capping mechanism and the conveyor mechanism;

execute a first determination of whether the conveyor mechanism is normal, the first determination being based on driving of the conveyor mechanism for a first period extending from a timing when the driving of the conveyor mechanism is started with the ejection space being in the capped state; and when the recording medium is sensed by the recording-medium sensing device within the first period, stop the driving of the conveyor mechanism even before the first period passes from the timing when the driving of the conveyor mechanism is started, wherein the controller is configured to continue the driving of the conveyor mechanism during a second period from the timing when the driving of the conveyor mechanism is started with the ejection space being in the capped state, wherein, when the recording medium is not sensed by the recording-medium sensing device during the second period from the timing when the driving of the conveyor mechanism is started, the controller determines that there is no recording medium remaining on the conveyance path at a position upstream of the ejection space, and wherein the controller is configured to, when the recording medium is sensed by the recording-medium sensing device within the second period from the timing when the driving of the conveyor mechanism is started, determine that there is a remaining recording medium remaining on the conveyance path at a position upstream of the ejection space.

9. The liquid ejection apparatus according to claim 8, wherein the controller is configured to, when the controller determines that there is a remaining recording medium remaining on the conveyance path at a position upstream of the ejection space, control the conveyor mechanism to convey the remaining recording medium along the conveyance path to a downstream side of the ejection space after the controller controls the capping mechanism to switch the state of the ejection space to the uncapped state and before the controller controls the liquid ejection head to eject the liquid onto the recording medium.

* * * * *